United States Patent [19]

Goodwin

[11] Patent Number: 4,650,342

[45] Date of Patent: Mar. 17, 1987

[54] AGITATING PARTICULATE SOLIDS

[75] Inventor: John Goodwin, Hanley, England

[73] Assignee: R. Goodwin International Ltd., Hanley, England

[21] Appl. No.: 864,578

[22] Filed: May 19, 1986

Related U.S. Application Data

[63] Continuation of Ser. No. 546,581, Oct. 28, 1983, abandoned.

[30] Foreign Application Priority Data

Oct. 28, 1982 [GB] United Kingdom ..... 8230887

[51] Int. Cl.[4] ..... B01F 7/22

[52] U.S. Cl. ..... 366/264; 366/295; 415/121 B; 415/143

[58] Field of Search ..... 366/262, 263, 265, 270, 366/264, 330, 342, 223 R, 325, 279, 155, 176, 293, 295; 416/237; 415/143, 121 B

[56] References Cited

U.S. PATENT DOCUMENTS

| | | | |
|---|---|---|---|
| 724,488 | 4/1903 | Murr | 416/223 |
| 2,460,757 | 2/1949 | Kurz | 366/264 |
| 2,875,897 | 3/1959 | Booth | 366/264 |
| 3,588,280 | 6/1971 | Yedidiah | 415/143 |
| 3,904,714 | 9/1975 | Rooney | 366/343 |
| 3,947,148 | 3/1976 | Holt | 416/223 |
| 3,973,866 | 8/1976 | Vaughan | 415/121 B |
| 3,984,001 | 10/1976 | Nagano | 366/293 |
| 4,378,093 | 3/1983 | Keener | 415/121 B |
| 4,456,424 | 6/1984 | Araoka | 415/143 |

FOREIGN PATENT DOCUMENTS

| | | | |
|---|---|---|---|
| 559177 | 7/1957 | Belgium | 366/262 |

OTHER PUBLICATIONS

Hazelton Submersible Pumps, R. Goodwin Int. Ltd., brochures (2).

R. Goodwin Int. Ltd., Pump 4N-BSS Characteristic Curve.

*Primary Examiner*—Robert W. Jenkins

*Attorney, Agent, or Firm*—Fleit, Jacobson, Cohn & Price

[57] ABSTRACT

The invention relates to a method of and apparatus for agitating and pumping particulate solids which are settled in and beneath a liquid by rotating a vaned impeller which is attached to a pump such that pressure waves are set up in the liquid and the settled solids, the solids being loosened so as to be pumpable, and the agitator being arranged to impart to its surroundings an axial component of movement towards the pump inlet.

12 Claims, 4 Drawing Figures

AGITATING PARTICULATE SOLIDS

This application is a continuation, of application Ser. No. 546,581, filed Oct. 28, 1983, now abandoned.

DESCRIPTION

This invention relates to a method of and apparatus for agitating particulate solids which have settled in and beneath a liquid in order to assist pumping of the solids by increasing the solid loading of the liquid, and for assisting in pumping of mixtures, suspensions and viscous liquids. The invention has particular, but by no means exclusive, application to pumping out ponds, reservoirs or lagoons in which have been deposited the products of mineral treatment plants, in particular coal washing plants, in which case they contain water together with settled and sedimented tailings and fines of coal. Obviously, generally similar applications such as pumping out sand-bottomed ponds and lakes, and indeed dredging channels, are possible.

In the particular application mentioned, the situations encountered may include ponds which have for many years stood idle, so that the coal fines and tailings have deposited and the sediment has become well compacted, and may at the other extreme include reservoirs or bunkers where coal fines have settled merely overnight. In any case, the sediment has intrinsic value, realisable if it can be recovered reasonably easily, as a fuel, where it may of course be desired to re-use the ponds or fill them and "landscape" the area.

A problem which is encountered with all types of sediment is that it is not sufficient merely to locate a pump at or just above the top of the sediment, because the pump would only pump water and hardly any of the fines would be entrained. In effect the water above the sediment would be removed and the upper part of the sedimented layers would become dewatered and it would not be possible to lower the pump into the sediment with a view to pumping it out. Thus, there have been proposals for disturbing sediment, particularly in the case of sand, with a view to increasing the solids content of the liquid. One proposal is to fit beneath a submersible centrifugal pump which is designed to have a downwardly opening inlet an impellor which is designed to cause a flow of water in a downward swirling motion so that the flow sweeps across the surface of the fines in the vicinity of the pump with a stirring action to loosen and entrain the fines in the water which is then pumped away. While this type of construction may be successful with certain types of settled particles, it certainly does not work very well on deposited coal tailings while at best its area of influence is rather small and its method of operation scarcely encourages induction of material into the eye of the pump. This means that any successful sediment agitation and loading of the liquid with solid particles will only be in the vicinity of the pump, so that it is necessary repeatedly to reposition the pump if any but the smallest area is to be cleared. A pump of the type just described is disclosed in British Patent Specification No. 2 070 687.

We have found that, despite this experience, it is possible to provide a satisfactory agitating effect using an agitator mounted adjacent a pump inlet.

According to the present invention there is provided a method of agitating and pumping particulate solids which are settled in and beneath a liquid by rotating a vaned agitator which is attached to a pump such that pressure waves are set up in the liquid and the settled solids, and the solids are loosened so as to be pumpable, the agitator being arranged to impart to its surroundings an axial component of movement towards the pump inlet.

The invention also provides apparatus for agitating and pumping particulate solids which are settled in and beneath a liquid including a vaned agitator attached to a pump and rotatable such that in use pressure waves are set up in the liquid and the settled solids, and the solids are loosened so as to be pumpable, the agitator being arranged so as to impart to its surroundings an axial component of movement towards the pump inlet.

The invention arises from the unexpected discovery that it is possible for the agitator to be so designed and rotated that it generates pressure waves and that these can be particularly effective in loosening the solids over a wide area. We have found that one excellent way to achieve this effect is to mount the agitator adjacent the pump inlet and to incline the vanes on the agitator and rotate it so that the agitator imparts an axial component of movement to the liquid/solid mixture which is towards the inlet to the pump. This axial component need not be great, but will assist in providing material to the pump. However, this is a secondary effect of the agitator, because we have found to our surprise that the primary effect of generating pressure waves can be remarkably effective in agitating and loosening the solids so that they begin to behave rather as if in a fluidised bed to which fluid is supplied from beneath. We are far from clear why this happens, but we believe it is concerned with the fact that the pressure waves set up by the agitator are in effect shock waves passing through the liquid and through the sediment which prove most effective in loosening the sediment. The reason for this may be that the shock or pressure waves are effective to disturb the surface tension forces which tend to hold the particles together. Thus, it is known that in sediments the passages and cavities between particles attract and retain liquid by capillary action, and the liquid once present holds the particles together by surface tension. The disturbance of the shock waves may well upset this arrangement and cause release of adjacent particles from each other, whereon they will be mobilized and free to "fluidize" and allow the pump to sink down amongst them. The agitator is most conveniently provided attached to a pump such as a submersible centrifugal pump. In, for instance, the primary application of pumping coal fines sediment, the sediment is mobilized and loosened so that the pump can be immersed in the sediment for most effective pumping thereof. When the agitator is mounted below the pump inlet, it will initially be located just above the surface of sediment, but as agitation proceeds it will be able to sink down into the sediment. The pump will follow it down and thus be more efficiently in contact with the material which it is to move.

It appears that the effect we have discovered is quite different from that of the earlier suggestions and, further, would not arise using apparatus which at first sight appears similar to that of the present invention. The agitator does not reaily function with a pumping action in any conventional sense; it has a much more widespread effect which offers the possibility of emptying ponds of considerable size without having to reposition the pump and/or the agitating means. It makes the sediment flow and increases the ability of the liquid and solids to be pumped.

These effects are not obtained with the prior art. For instance, U.S. Pat. No. 3,973,866 shows a screw propeller below the inlet to the centrifugal pump, but this propeller has sharpened leading edges and is swept back abruptly, so as firstly to facilitate entry of matter to be pumped, secondly to slice large articles and thirdly to displace articles that are too hard to slice. This propeller will not produce shock waves. Similar remarks apply to European Specification No. 0 057 319 which additionally has a skirt surrounding the sharpened propeller, thus preventing propagation of any shock waves were they to arise while there are other prior constructions, such as cutters for manure pumps (U.S. Pat. No. 3,155,330) and mixing blades at the inlet ends of auger pumps (British Specification No. 1 270 106) which while having prima facie similarity to the present invention would not display the properties with which the invention is concerned.

With the invention the agitator can be located either above or below the pump depending on whether the pump inlet faces upwards or downwards in use. Generally, the vanes of the agitator will make only a small angle with the agitator axis, for instance an angle of about 10°, but in certain circumstances much larger angles of up to 30° or even up to 80° may prove appropriate. Thus an angle between 2° and 40°, preferably between 5° and 20° is generally desirable, depending on the inductive effect desired and its effect on the wave generation and consequent mobilization of the particles.

It is not clearly understood why the provision of an agitator of this type in such an arrangement should be so effective in agitating settled solid particles, but as mentioned above it does appear that some shock wave effect is induced by the vanes. Such an effect appears most effective when the vanes of the agitator are oriented so as to impart the axial component towards the pump inlet, though the axial pumping effect is probably subsidiary. Accordingly, the provision of the agitator is quite different from the provision and function of inductors which have been known to assist in feeding material to the impeller of a centrifugal pump. In fact, such inductors have inevitably been provided in a conduit so that they operate somewhat like an Archemedean screw.

It is a surprise that the provision of an agitator of this type agitates sediment over a wide area. The sediment being agitated increases the solids content per unit volume of the liquid above it and the centrifugal pump can more effectively pump out the solids. In this respect the invention offers a significant advance over the impellers of the type which operate to provide a downward liquid motion for the purpose of agitation which are effective only locally. In addition, there is thought to be an effect of reducing the viscosity of parts of the liquid containing solid without diminishing solid content but in such a way as to assist pumping. Further, when the agitator is provided just adjacent the pump inlet there will be some assistance in feeding solids thereto, and further again the apparatus of the invention may with advantage be used to assist pumping of liquids of a viscous or thixotropic nature whether or not including a suspension of particles.

Particularly when the agitator is beneath the pump, it is preferable for there to be an apertured skirt surrounding the agitator so that the pump can rest on a hard surface such as the bottom of a concrete bunker without damage to the agitator. In addition the skirt may assist in propagation of the pressure waves.

The invention will be more clearly understood from the following description which is given by way of example only with reference to the accompanying drawings, in which.

Figure 1:
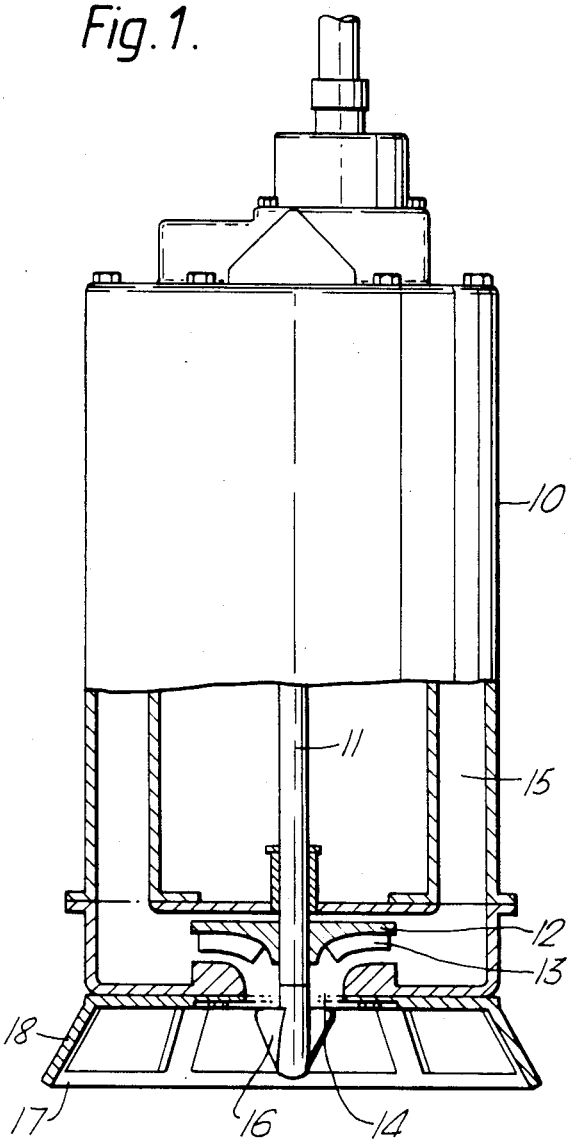
FIG. 1 is a vertical part sectional view of a centrifugal pump provided with an agitator below its downwardly facing inlet.
Figure 2:
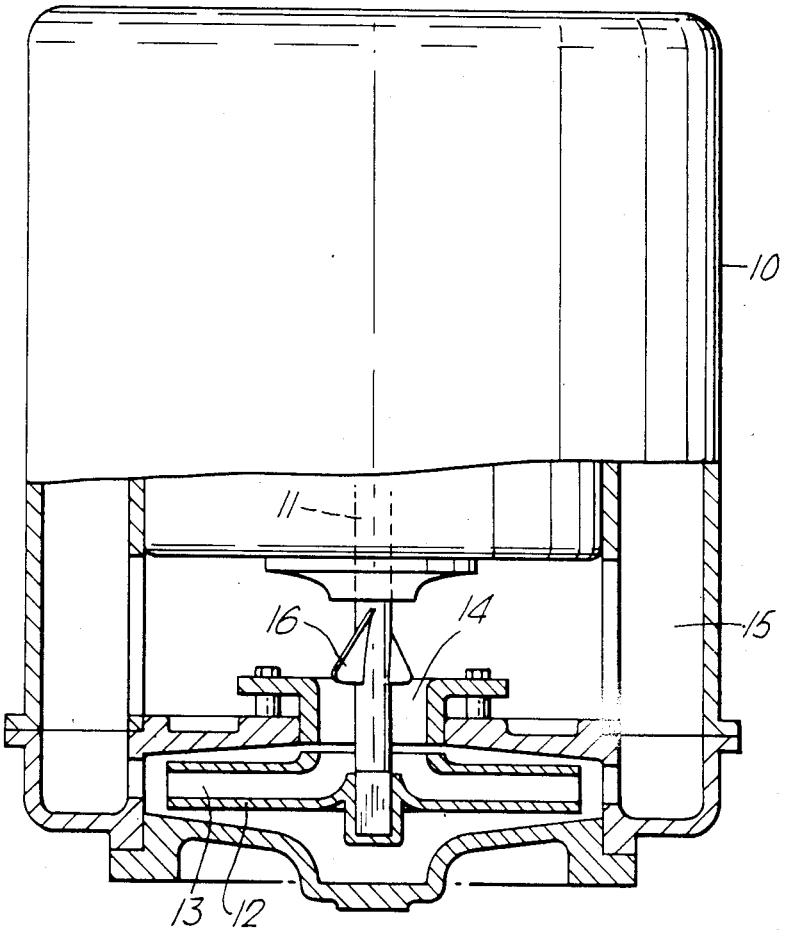
FIG. 2 is a vertical part sectional view of a centrifugal pump provided with an agitator above an upwardly facing inlet.

Shown in FIGS. 1 and 2 are submersible centrifugal pumps each having a housing 10 containing a motor (not shown) from which extends a drive shaft 11 on which is mounted a pump impeller 12 having vanes 13 to urge liquid from an inlet 14 centrifugally outwards and then upwards through water channels 15 to emerge from an outlet from the pump (not shown). Attached on the shaft 11 in FIG. 2 above the impeller, and at the bottom of the shaft 11 in FIG. 1, is an agitator 16 which as shown has a cylindrical boss on which generally radially extending vanes are mounted.

In the FIG. 1 embodiment the agitator extends downwards within a protective apertured skirt comprising a circular rim 17 supported on legs 18 from the bottom of the pump. The rim is designed to rest on a hard surface to protect the agitator. The skirt may assist in propagating shock waves, e.g. by itself resonating. The blades 16 of the agitator are inclined at a relatively small angle to the axis of the agitator and the inclination is such that the axial component of thrust induced in liquid upon rotation is upwards towards the pump.

In the FIG. 2 embodiment the agitator is above the inlet 14 to the pump, and the pump feeds upwardly through two channels 15 which are diametrically opposed. The space between these channels is open to allow access to the inlet and the agitator is effective to create the pressure waves through these open areas.

Figure 3:
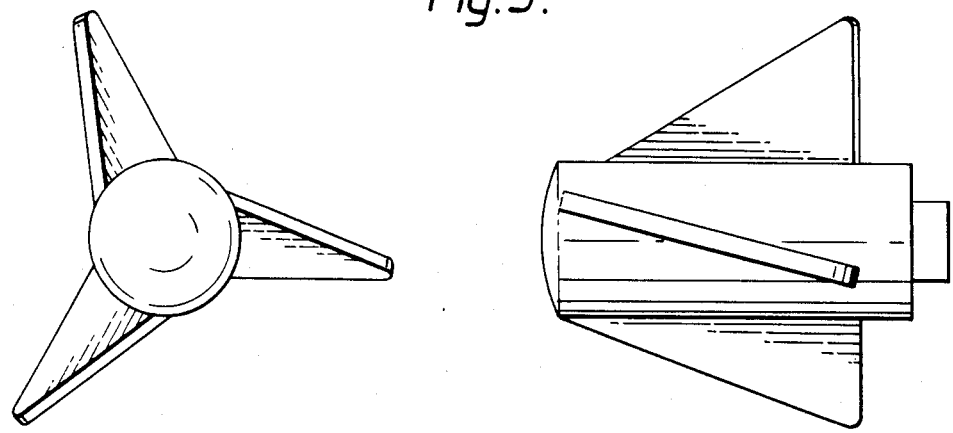
FIGS. 3 and 4 are side views of the agitators suitable for use with the invention.
Figure 4:
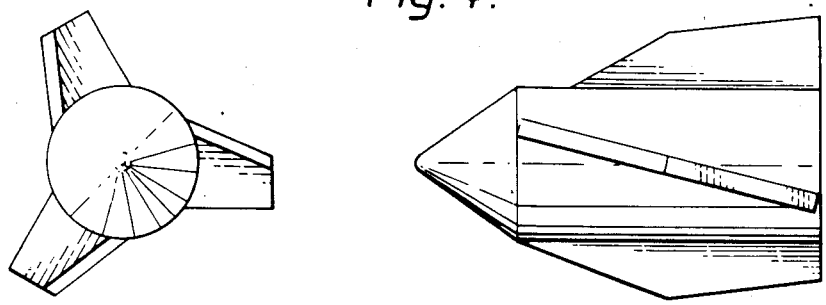

Two or more vanes can be provided on the agitator, the preferred numbers being three or four. FIG. 3 shows a side and end view of one possible form of agitator and FIG. 4 shows side and end views of another form, the latter having a tapered nose projecting beyond the ends of the vanes which is found significantly to increase the agitating effect and thus the effect of the overall apparatus in pumping solids entrained in the liquid.

It may be noted that the agitators shown are quite small. This ensures that the desired effect is obtained without consumption of excessive energy, and that the energy which is used is effectively employed in agitation. Further, the inclined blades will not display any significant tendancy to propel the apparatus in any direction as they exert little axial thrust. It is desirable to design and run the apparatus so that maximum resonance is observed. This appears to increase the fluidising effect. Indeed trials have indicated that a large percentage weight of solids, in fact 65% or more, can be pumped and can be agitated over a wide area. The agitators are not, therefore, primarily propellors or impellers, and they do need to be clear, or largely clear, of surrounding structures or casing which resist shock wave propagation. However, the structures shown which allow such propagation may in fact assist it.

One specific example will be described in detail.

Beneath a 40 horse power (30 kilowatt) centrifugal pump having a bottom inlet and a 4 inch (10 cms) outlet is attached an agitator having three vanes on a shaft. The shaft has a 2 inch (5 cms) diameter and the vanes extend radially outwards to a maximum of 1 inch (2.5 cms) from the shaft surface but taper towards the bottom and have a length of 5 inches (12.5 cms). The pump is equipped also with a skirt such as is shown at 17 in FIGS. 1 and 2, this having a depth of 6 inches (15 cms) so that the agitator is protected when the pump is stood on a hard surface and a diameter of about 2 feet (60 cms). When rotated at about 1440 rpm the apparatus is exceedingly effective at agitating sedimented particles over a wide area, and pumping them, with solids contents in excess of 65% being noted in the pumped material. The agitating effect is a marked improvement over that offered by prior apparatus.

I claim:

1. A method of agitating and pumping particulate solids which are in and beneath a liquid by attaching a vaned agitator to a pump, the vanes of the agitator being at an angle of up to 30° relative to the axis of the agitator, rotating the agitator so that it imparts to its surroundings an axial component of movement towards an inlet of the pump, said angle of said blades being such as to produce cavitation pressure waves in the liquid and the settled solids, and the solids are loosened so as to be pumpable with the liquid, and pumping the liquid and solids with the pump.

2. A method according to claim 1 wherein the pump is a centrifugal pump.

3. A method according to claim 1 wherein there are two to four vanes on the agitator.

4. A method according to claim 1 wherein the vanes are at an angle of about 10° to the axis of the impeller.

5. A method according to claim 1 wherein the pump is equipped with an apertured skirt in which the agitator is located, such skirt resonating with rotation of the agitator.

6. Apparatus for agitating and pumping particulate soilds which are in and beneath a liquid, such apparatus including a pump, an inlet to the pump, an agitator attached to said pump, said agitator having an axis of rotation, vanes on said agitator, said vanes being at an angle of up to 30° with respect to said axis, said agitator being rotatable in a direction so as to impart to its surroundings an axial component of movement towards said pump inlet, and said angle of said blades being such as to produce cavitation pressure waves in the liquid and the settled solids upon rotation of the agitator, and the solids so as to be pumpable with the liquid.

7. Apparatus according to claim 6 wherein the pump inlet opens downwards and the agitator is beneath the inlet.

8. Apparatus according to claim 7 including an apertured skirt beneath the pump in which the agitator is located.

9. Apparatus according to claim 6 wherein the pump inlet opens upwards and the agitator is above the inlet.

10. Apparatus according to claim 6 wherein the vanes of the impeller make an angle of about 10° with the axis of the impeller.

11. Apparatus according to claim 6 wherein there are two to four vanes on the impeller.

12. Apparatus according to claim 6 wherein the pump is a centrifugal pump.

* * * * *